US011640866B2

(12) United States Patent
Han et al.

(10) Patent No.: US 11,640,866 B2
(45) Date of Patent: May 2, 2023

(54) COIL COMPONENT

(71) Applicant: SAMSUNG ELECTRO-MECHANICS CO., LTD., Suwon-si (KR)

(72) Inventors: Seung Ho Han, Suwon-si (KR); Sung Sik Shin, Suwon-si (KR); Jae Wook Lee, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 806 days.

(21) Appl. No.: 16/567,549

(22) Filed: Sep. 11, 2019

(65) Prior Publication Data

US 2020/0286662 A1 Sep. 10, 2020

(30) Foreign Application Priority Data

Mar. 5, 2019 (KR) ..... 10-2019-0025073

(51) Int. Cl.

| | |
|---|---|
| ***H01F 17/00*** | (2006.01) |
| ***H01F 27/29*** | (2006.01) |
| ***H01F 27/28*** | (2006.01) |
| ***H01F 41/04*** | (2006.01) |
| ***H01F 1/147*** | (2006.01) |
| ***H01F 17/04*** | (2006.01) |

(52) U.S. Cl.

CPC ..... *H01F 17/0013* (2013.01); *H01F 1/1475* (2013.01); *H01F 17/04* (2013.01); *H01F 27/2804* (2013.01); *H01F 27/292* (2013.01); *H01F 41/041* (2013.01); *H01F 2017/048* (2013.01)

(58) Field of Classification Search

CPC .. H01F 17/0013; H01F 17/04; H01F 27/2804; H01F 27/292; H01F 41/041

See application file for complete search history.

(56) References Cited

U.S. PATENT DOCUMENTS

| | | | | |
|---|---|---|---|---|
| 2009/0237894 | A1* | 9/2009 | Ueda | H01L 23/645 336/200 |
| 2013/0020914 | A1* | 1/2013 | Tsu | H01G 4/232 336/200 |
| 2015/0380151 | A1* | 12/2015 | Choi | H01F 41/041 336/200 |
| 2016/0268038 | A1* | 9/2016 | Choi | H01F 41/041 |
| 2017/0110240 | A1* | 4/2017 | Masuda | H01F 27/292 |

(Continued)

FOREIGN PATENT DOCUMENTS

| | | | |
|---|---|---|---|
| JP | 2007242806 A | * | 9/2007 |
| JP | 2018-37516 A | | 3/2018 |

(Continued)

*Primary Examiner* — Elvin G Enad
*Assistant Examiner* — Malcolm Barnes
(74) *Attorney, Agent, or Firm* — Morgan, Lewis & Bockius LLP

(57) ABSTRACT

A coil component includes a body, a coil portion embedded in the body, first and second external electrodes spaced apart from each other on an external surface of the body and connected to the coil portion, and an identification portion in which a plurality of fine patterns spaced apart from one another are grouped and which is disposed on the external surface of the body. Each of the plurality of fine patterns includes an insulating resin.

16 Claims, 5 Drawing Sheets

(56) References Cited

U.S. PATENT DOCUMENTS

| | | | | |
|---|---|---|---|---|
| 2018/0061551 | A1* | 3/2018 | Kondou | H01F 27/2804 |
| 2018/0315545 | A1* | 11/2018 | Kusumoto | H01F 27/292 |
| 2019/0199310 | A1* | 6/2019 | Sato | H03H 3/00 |
| 2020/0082990 | A1* | 3/2020 | Yamamoto | H01F 27/363 |

FOREIGN PATENT DOCUMENTS

| | | | |
|---|---|---|---|
| KR | 10-2009-0033115 | A | 4/2009 |
| KR | 10-2017-0074105 | A | 6/2017 |

* cited by examiner

I–I'

II–II'

COIL COMPONENT

CROSS-REFERENCE TO RELATED APPLICATION(S)

This application claims the benefit under 35 USC § 119 (a) of Korean Patent Application No. 10-2019-0025073 filed on Mar. 5, 2019 in the Korean Intellectual Property Office, the entire disclosure of which is incorporated herein by reference for all purposes.

TECHNICAL FIELD

The present disclosure relates to a coil component.

BACKGROUND

Inductors and other coil components are representative passive electronic components used in electronics along with resistors and capacitors.

Coil components may be provided with marking parts for the purpose of direction identification, or the like, printed on circuit boards or the like. In general, marking parts are formed by printing a paste material containing a nonmagnetic substance on surfaces of components.

As the size of coil components is reduced, the influence of marking parts on magnetic characteristics of coil components is further increased.

SUMMARY

An aspect of the present disclosure is to provide a coil component which is easy to identify while an identification portion has a relatively reduced thickness.

An aspect of the present disclosure is to provide a coil component capable of having a reduced volume of a nonmagnetic body, in the same volume as that of the related art.

According to an aspect of the present disclosure, a coil component includes a body, a coil portion embedded in the body, first and second external electrodes spaced apart from each other on an external surface of the body and connected to the coil portion, and an identification portion in which a plurality of fine patterns spaced apart from one another are grouped and which is disposed on the external surface of the body. Each of the plurality of fine patterns includes an insulating resin.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
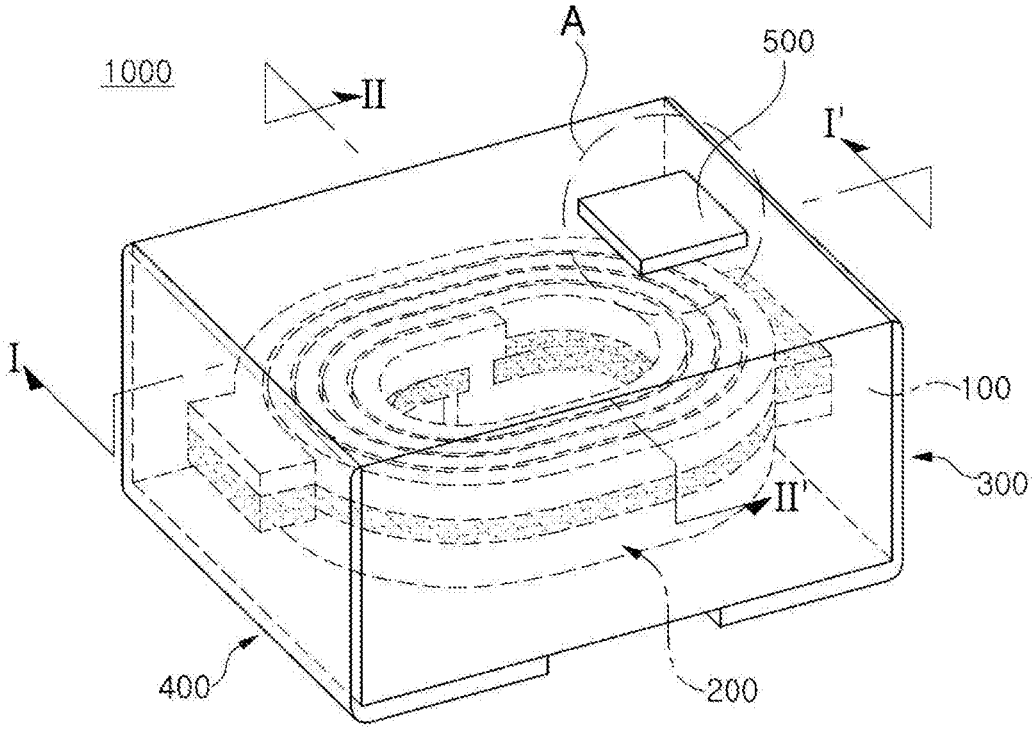
FIG. 1 is a perspective view schematically illustrating a coil component according to an embodiment.

The following detailed description is provided to assist the reader in gaining a comprehensive understanding of the methods, apparatuses, and/or systems described herein. However, various changes, modifications, and equivalents of the methods, apparatuses, and/or systems described herein will be apparent to one of ordinary skill in the art. The sequences of operations described herein are merely examples, and are not limited to those set forth herein, but may be changed, as will be apparent to one of ordinary skill in the art, with the exception of operations necessarily occurring in a certain order. Also, descriptions of functions and constructions that would be well known to one of ordinary skill in the art may be omitted for increased clarity and conciseness.

The terminology used herein describes particular embodiments only, and the present disclosure is not limited thereby. As used herein, the singular forms "a," "an," and "the" are intended to include the plural forms as well, unless the context clearly indicates otherwise. It will be further understood that the terms "including", "comprises," and/or "comprising" when used in this specification, specify the presence of stated features, integers, steps, operations, members, elements, and/or groups thereof, but do not preclude the presence or addition of one or more other features, integers, steps, operations, members, elements, and/or groups thereof.

Throughout the specification, it will be understood that when an element, such as a layer, region or wafer (substrate), is referred to as being "on," "connected to," or "coupled to" another element, it may be directly "on," "connected to," or "coupled to" the other element or other elements intervening therebetween may be present. In contrast, when an element is referred to as being "directly on," "directly connected to," or "directly coupled to" another element, there may be no elements or layers intervening therebetween. Like numerals refer to like elements throughout. As used herein, the term "and/or" includes any and all combinations of one or more of the associated listed items.

In addition, the term "coupled" is used not only in the case of direct physical contact between the respective constituent elements in the contact relation between the constituent elements, but also in the case in which other constituent elements are interposed between the constituent elements such that they are in respective contact with each other, being used as a comprehensive concept.

The drawings may not be to scale, and the relative size, proportions, and depiction of elements in the drawings may be exaggerated for clarity, illustration, and convenience.

In the drawing, the L direction may be defined as a first direction or a length direction, the W direction as a second direction or a width direction, and the T direction as a third direction or a thickness direction.

Hereinafter, a coil component according to an embodiment in the present disclosure will be described in detail with reference to the accompanying drawings. Referring to the accompanying drawings, the same or corresponding components are denoted by the same reference numerals, and redundant descriptions thereof will be omitted.

Various types of electronic components are used in electronic devices. Various types of coil components may be suitably used for noise removal or the like between these electronic components.

For example, as a coil component in an electronic device, a power inductor, a high frequency inductor (HF Inductor), a general bead, a bead for high frequency (GHz Bead), a common mode filter, or the liken used.

Embodiment

Figure 2:
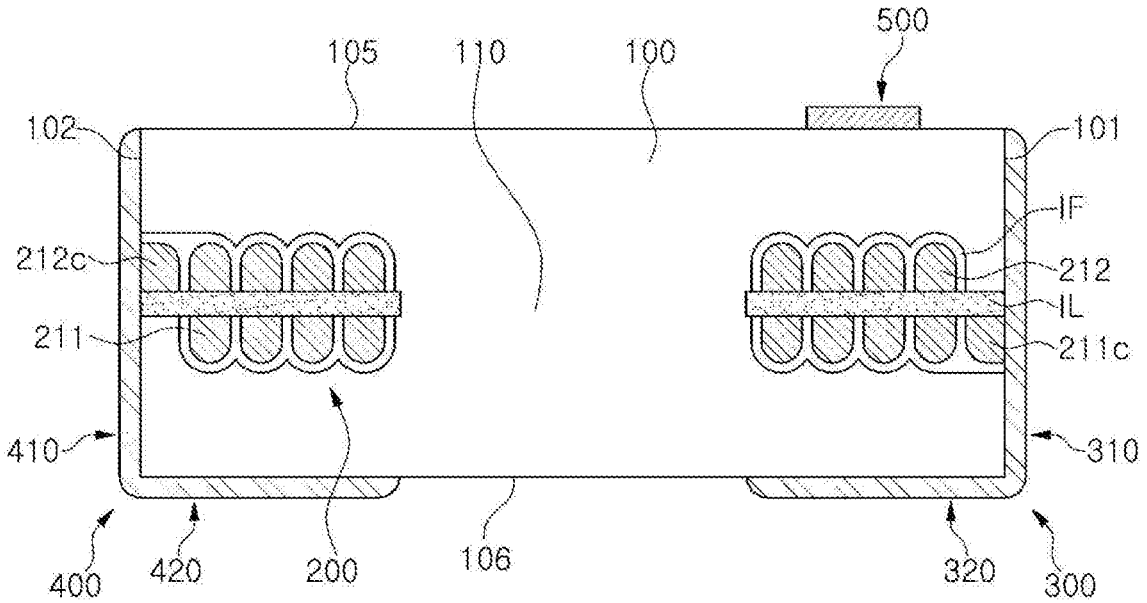
FIG. 2 is a cross-sectional view taken along line I-I' in FIG. 1.
Figure 3:
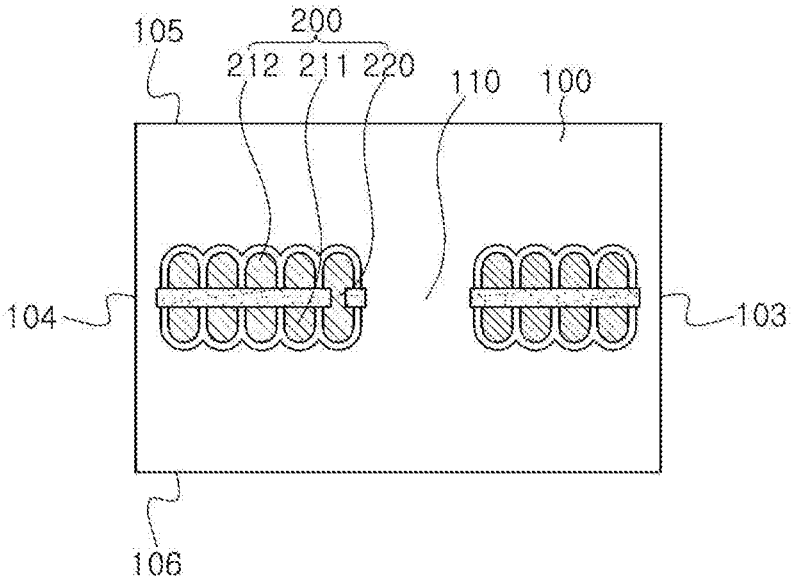
FIG. 3 is a cross-sectional view taken along line II-II' in FIG. 1.
Figure 4:
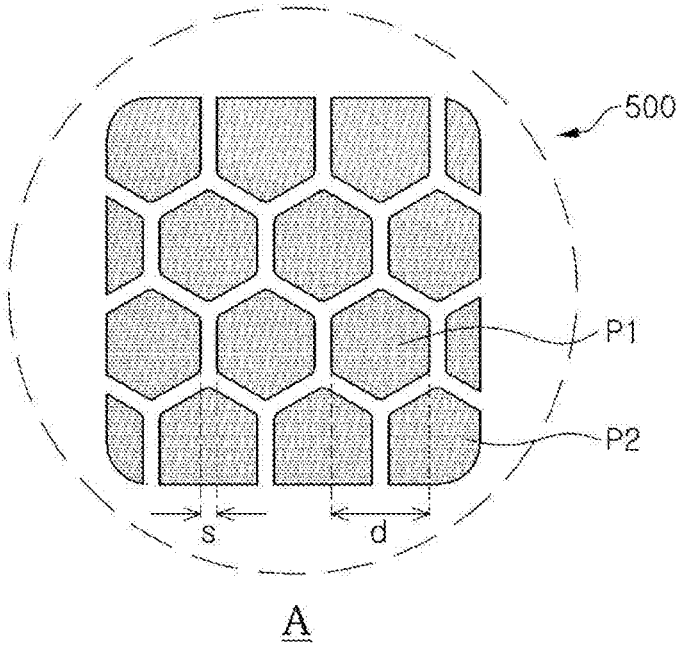
FIGS. 4 to 7 are enlarged views of portion A in FIG. 1, and illustrate an identification portion as an example.

FIG. 1 is a perspective view schematically illustrating a coil component according to an embodiment. FIG. 2 is a cross-sectional view taken along line I-I' in FIG. 1. FIG. 3 is a cross-sectional view taken along line II-II' in FIG. 1. FIGS. 4 to 7 are enlarged views of portion A in FIG. 1 and illustrate an identification portion by way of example.

Referring to FIGS. 1 to 7, a coil component 1000 according to an embodiment may include a body 100, a coil portion 200, first and second external electrodes 300 and 400, and an identification portion 500, and may further include an internal insulating layer IL and an insulating film IF.

The body 100 forms the shape of the coil component 1000 according to the embodiment. The body 100 may be formed to have a hexahedral shape as a whole.

Hereinafter, an embodiment in the present disclosure will be described with reference to a case in which the body 100 has a hexahedral shape by way of example. However, these descriptions do not exclude coil components that include bodies formed in shapes other than hexahedral, within the scope of the present disclosure.

Referring to FIGS. 2 and 3, the body 100 has a first surface 101 and a second surface 102 opposing each other in a length direction L, a third surface 103 and a fourth surface 104 opposing each other in a width direction W, and a fifth surface 105 and a sixth surface 106 opposing in a thickness direction T. Each of the first to fourth surfaces 101, 102, 103 and 104 of the body 100 corresponds to a wall surface of the body 100, connecting the fifth surface 105 and the sixth surface 106 of the body 100 to each other. In the following description, both ends of the body 100 among a plurality of wall surfaces thereof refer to the first surface 101 and the second surface 102 of the body 100, and both opposing side surfaces of the body 100 among the plurality of wall surfaces thereof may refer to the third surface 103 and the fourth surface 104 of the body 100.

The body 100 may be formed, in such a manner that, the coil component 1000 according to an embodiment, including external electrodes 300 and 400, a first insulating layer 510 and a second insulating layer 520, to be described later, may be formed to have specified dimensions such as, for example, a length of about 2.0 mm, a width of about 1.2 mm, and a thickness of about 0.65 mm. It will be appreciated that the the particular dimensions of the body 1000 are not limited, and therefore, a body with dimensions other than those explicitly described herein is within the scope of the present disclosure. As used herein, about refers to values different from the actual value of a dimension (or other quantity) resulting from process errors.

The body 100 may include a magnetic material and a resin. In detail, the body 100 may be formed by laminating one or more magnetic composite sheets including a resin and a magnetic material dispersed in the resin. In addition, the body 100 may also have a structure in addition to the structure in which the magnetic material is dispersed in the resin. For example, the body 100 may be formed of a magnetic material such as ferrite.

The magnetic material may be ferrite or a metal magnetic powder.

Ferrite powder may be one or more of spinel type ferrite such as Mg—Zn type, Mn—Zn type, Mn—Mg type, Cu—Zn type, Mg—Mn—Sr type, Ni—Zn type or the like, hexagonal ferrite such as Ba—Zn, Ba—Mg, Ba—Ni, Ba—Co, Ba—Ni—Co type, or the like, garnet type ferrite such as Y type or the like, and Li-based ferrite.

The metal magnetic powder may include one or more selected from the group consisting of iron (Fe), silicon (Si), chromium (Cr), cobalt (Co), molybdenum (Mo), aluminum (Al), niobium (Nb), copper (Cu) and nickel (Ni). For example, the metal magnetic powder may be at least one or more selected from the group consisting of pure iron powder, Fe—Si alloy powder, Fe—Si—Al alloy powder, Fe—Ni alloy powder, Fe—Ni—Mo alloy powder, Fe—Ni—Mo—Cu alloy powder, Fe—Co alloy powder, Fe—Ni—Co alloy powder, Fe—Cr alloy powder, Fe—Cr—Si alloy powder, Fe—Si—Cu—Nb alloy powder, Fe—Ni—Cr alloy powder, and Fe—Cr—Al alloy powder.

The metal magnetic powder may be amorphous or crystalline. For example, the metal magnetic powder may be a Fe—Si—B—Cr amorphous alloy powder, but is not limited thereto.

The ferrite and the metal magnetic powder may have an average diameter of, e.g., about 0.1 μm to about 30 μm, respectively, but embodiments thereof are not limited thereto.

The body 100 may include two or more kinds of magnetic materials dispersed in a resin. In this case, the term "different kinds of magnetic materials" means that the magnetic materials dispersed in the resin are distinguished from each other by at least one of an average diameter, a composition, crystallinity and a shape.

The resin may include, but is not limited to, epoxy, polyimide, liquid crystal polymer, or the like, alone or in combination.

The body 100 includes the coil portion 200 and a core 110 passing through an internal insulating layer IL, to be described later. The core 110 may be formed by filling a through hole of the coil portion 200 with a magnetic composite sheet, but an embodiment thereof is not limited thereto.

The coil portion 200 is embedded in the body 100 to exhibit characteristics of a coil component. For example, when the coil component 1000 according to the embodiment is used as a power inductor, the coil portion 200 may function to stabilize the power supply of an electronic device by storing an electric field as a magnetic field and maintaining an output voltage. Both ends of the coil portion 200 may be exposed to the first and second surfaces 101 and 102 of the body 100, respectively.

The coil portion 200 applied to this embodiment includes a first coil pattern 211, a second coil pattern 212, and a via 220.

The first coil pattern 211, the internal insulating layer IL and the second coil pattern 212 to be described later may be sequentially laminated in a thickness direction T of the body 100.

Each of the first coil pattern 211 and the second coil pattern 212 may be formed to have a flat spiral shape. As an example, the first coil pattern 211 may include at least one turn about the core 110 of the body 100 on one surface of the internal insulating layer IL (a lower surface of IL in FIG. 2). The second coil pattern 212 may include at least one turn about the core 110 of the body 100 on the other surface of the internal insulating layer IL (an upper surface of IL in FIG. 2). The first and second coil patterns 211 and 212 may be wound in the same direction.

The via 220 penetrates through the internal insulating layer IL to electrically connect the first coil pattern 211 and the second coil pattern 212 to each other, to respectively be in contact with the first coil pattern 211 and the second coil pattern 212. As a result, the coil portion 200 according to the embodiment may be formed as a single coil that generates a magnetic field in the thickness direction T of the body 100 in the body 100.

At least one of the first coil pattern 211, the second coil pattern 212, and the via 220 may include at least one conductive layer.

As an example, in the case in which the second coil pattern 212 and the vias 220 are formed by a plating method, the second coil pattern 212 and the via 220 may each include a seed layer and an electroplating layer. The seed layer may be formed by an electroless plating method or a vapor deposition method such as sputtering or the like. The electroplating layer may have a single-layer structure or a multi-layer structure. The electroplating layer of the multi-layer structure may be formed to have a conformal film structure in which one electroplating layer is covered by another electroplating layer, and may also be formed to have a form in which only on one surface of one electroplating layer, another electroplating layer is laminated. A seed layer of the second coil pattern 212 and a seed layer of the via 220 may be integrally formed without forming a boundary therebetween, but an embodiment thereof is not limited thereto. The electroplated layer of the second coil pattern 212 and the electroplated layer of the via 220 may be integrally formed without forming a boundary therebetween, but an embodiment thereof is not limited thereto.

As another example, in a case in which the first coil pattern 211 and the second coil pattern 212 are separately formed and then laminated together on the internal insulating layer IL to form the coil portion 200, the via 220 may include a high melting point metal layer and a low melting point metal layer having a melting point lower than that of the high melting point metal layer. In this case, the low melting point metal layer may be formed of a solder containing lead (Pb) and/or tin (Sn). The low melting point metal layer is at least partially melted due to pressure and temperature at the time of lamination, in such a manner that an intermetallic compound layer (IMC layer) may be formed in at least one of gaps between the low melting point metal layer and the first coil pattern 211, between the low melting point metal layer and the second coil pattern 212, and the high melting point metal layer and the low melting point metal layer.

In an example referring to FIG. 2, the first coil pattern 211 and the second coil pattern 212 may protrude from a lower surface and an upper surface of the internal insulating layer IL, respectively. In another example with reference to FIG. 2, the first coil pattern 211 may be embedded in the lower surface of the internal insulating layer IL in such a manner that a lower surface thereof is exposed to the lower surface of the internal insulating layer IL, and the second coil pattern 212 may be exposed to an upper surface of the internal insulating layer IL. In this case, a concave portion is formed in the lower surface of the first coil pattern 211, such that the lower surface of the internal insulating layer IL and the lower surface of the first coil pattern 211 may not be located on the same plane. As another examples with reference to FIG. 2, the first coil pattern 211 may be embedded in the lower surface of the internal insulating layer IL in such a manner that the lower surface thereof is exposed to the lower surface of the internal insulating layer IL, and the second coil pattern 212 may be embedded in the upper surface of the internal insulating layer IL in such a manner that an upper surface thereof may be exposed to the upper surface of the internal insulating layer IL.

Ends of the first coil pattern 211 and the second coil pattern 212 may be exposed to the first and second surfaces 101 and 102 of the body 100, respectively, to form first and second connecting portions 211C and 212C. An end of the first coil pattern 211 exposed to the first surface 101 of the body 100, i.e., the first connecting portion 211C, contacts a first external electrode 300 to be described later, to be electrically connected to the first external electrode 300. An end of the second coil pattern 212 exposed to the second surface 102 of the body 100, i.e., the second connecting portion 212C, contacts a second external electrode 400 to be described later, to be electrically connected to the second external electrode 400.

The first coil pattern 211, the second coil pattern 212 and the vias 220 may respectively be formed of a conductive material, such as copper (Cu), aluminum (Al), silver (Ag), tin (Sn), gold (Au), nickel (Ni), lead (Pb), titanium (Ti), alloys thereof, or the like, but a material thereof is not limited thereto.

The first and second coil patterns 211 and 212 are formed on both surfaces of the internal insulating layer IL, respectively. For example, the internal insulating layer IL supports the first and second coil patterns 211 and 212.

The internal insulating layer IL may be formed of an insulating material including a thermosetting insulating resin such as an epoxy resin, a thermoplastic insulating resin such as polyimide, or a photoimageable dielectric resin, or an insulating material in which a reinforcing material such as glass fiber or inorganic filler is impregnated with these insulating resins. For example, the internal insulating layer IL may be formed of an insulating material such as a prepreg, an Ajinomoto Build-up Film (ABF), an FR-4, a Bismaleimide Triazine (BT) resin, or photoimageable dielectric (PID), but an embodiment thereof is not limited thereto.

The inorganic filler may be one or more selected from the group consisting of silica ($SiO_2$), alumina ($Al_2O_3$), silicon carbide (SiC), barium sulphate ($BaSO_4$), talc, mud, mica powder, aluminum hydroxide ($AlOH_3$), magnesium hydroxide ($Mg(OH)_2$), calcium carbonate($CaCO_3$), magnesium carbonate ($MgCO_3$), magnesium oxide (MgO), boron nitride (BN), aluminum borate ($AlBO_3$), barium titanate ($BaTiO_3$) and calcium zirconate ($CaZrO_3$).

In the case in which the internal insulating layer IL is formed of an insulating material including a reinforcing material, the internal insulating layer IL may provide relatively better rigidity. In the case in which the internal insulating layer IL is formed of an insulating material not containing a glass fiber, the internal insulating layer IL may be advantageous in terms of thinning an overall thickness of the coil component 1000 according to the embodiment. In the case in which the internal insulating layer IL is formed of an insulating material containing a photoimageable dielectric resin, the number of processes is reduced, which may be advantageous in terms of reducing the production cost and fine hole processing.

The first and second external electrodes 300 and 400 are spaced apart from each other on the sixth surface 106 of the body 100, and are respectively connected to the coil portion 200. The first external electrode 300 includes a first connection portion 310 disposed on the first surface 101 of the body 100 and connected to the first connecting portion 211C, and a first extension 320 extending from the first connection portion 310 onto the sixth surface 106 of the body 100. The second external electrode 400 includes a second connection portion 410 disposed on the second surface 102 of the body 100 and connected to the second connecting portion 212C, and a second extension 420 extending from the second connection portion 410 onto the sixth surface 106 of the body 100. The first extension 310 and the second extension 410 disposed on the sixth surface 106 of the body 100 are spaced apart from each other to prevent a short between the first external electrode 300 and the second external electrode 400.

The first and second external electrodes 300 and 400 may be formed by a vapor deposition method such as sputtering or the like, a plating method, or a paste printing method. In forming the first and second external electrodes 300 and 400, the first and second connection portions 310 and 410 and the extensions 320 and 420 may be formed by separate processes, and a boundary between the first and second connection portions 310 and 410 and the extensions 320 and 420 may be formed. Alternatively, the first and second connection portions 310 and 410 and the extensions 320 and 420 may be formed in the same process, to be integrally formed without forming a boundary therebetween.

The first and second external electrodes 300 and 400 may be formed of a conductive material, such as copper (Cu), aluminum (Al), silver (Ag), tin (Sn), gold (Au), nickel (Ni), lead (Pb), titanium (Ti), alloys thereof, or the like, but a material thereof is not limited thereto. Each of the first and second external electrodes 300 and 400 may have a single layer structure or a structure including a plurality of layers. In the case of the structure having a plurality of layers, the first and second external electrodes 300 and 400 may each include a conductive resin layer including a conductive powder and a resin, a nickel plating layer including nickel (Ni), and a tin plating layer including tin (Sn), but an embodiment thereof is not limited thereto.

The first and second external electrodes 300 and 400 electrically connect the coil component 1000 to a printed circuit board or the like when the coil component 1000 according to an embodiment is mounted on the printed circuit board or the like. As an example, the coil component 1000 according to the embodiment may be mounted after the sixth surface 106 of the body 100 is disposed to face the printed circuit board. Therefore, the coil component 1000 according to the embodiment may be easily connected to a printed circuit board or the like due to the first and second extensions 320 and 420 together disposed on the sixth surface 106 of the body 100.

On the other hand, FIGS. 1 to 3 illustrate that the first and second external electrodes 300 and 400 applied to the embodiment are L-shaped, respectively, but are merely illustrative. For example, the first and second external electrodes 300 and 400 may be respectively formed in the form of a fifth surface electrode or a third surfaces electrode, or may be formed only on the sixth surface 106 of the body 100 to be spaced apart from other thereon.

The identification portion 500 is a group of a plurality of fine patterns P1 and P2 spaced apart from each other and is disposed on an outer surface of the body 100. The identification portion 500 may be formed to specify a surface of formation of the first and second external electrodes 300 and 400, from among outer surfaces of the body 100, or to specify a mounting surface of the coil component 1000 when the coil component 1000 according to the embodiment is mounted on a printed circuit board. The plurality of fine patterns P1 and P2 constituting the group may include an insulating resin.

Generally, a marking part formed on an electronic component is formed by printing an insulating paste containing a nonmagnetic substance on an outer surface of the electronic component. The insulating paste may include an insulating resin and a nonmagnetic filler. Such a marking part is generally formed integrally on an entire outer surface of the electronic component to occupy the entire region of formation of the marking part. As an example, in a case in which a marking part is formed in a region having the area of 400 μm×400 μm in the outer surface of the electronic component, the marking part is integrally formed in the region, and has the same area as the area of the region on the outer surface of the body 100. However, in a case in which the insulating paste is printed on the entirety of the region on the outer surface of the body 100, the marking part is inevitably formed relatively thick due to characteristics of the insulating paste. In this case, as the size of the electronic component is reduced, the volume of the marking part relative to the volume of the entire component is inevitably relatively increased, affecting characteristics of the electronic component.

In consideration of such characteristic, in an embodiment of the present disclosure, when the identification portion 500 is formed by printing on a portion of the outer surface of the body 100, the identification portion 500 is not formed integrally, but is formed in such a manner that a plurality of fine patterns P1 and P2 are clustered. The plurality of fine patterns P1 and P2 spaced apart from each other are respectively formed relatively smaller than a marking part of the related art, such that a thickness thereof may be relatively reduced. Therefore, the identification portion 500 according to an embodiment in the present disclosure, in which the plurality of fine patterns P1 and P2 are grouped, has the same occupancy area as that in the related art, on the outer surface of the body 100, and has a relatively reduced thickness, as compared with that of the related art marking part. As a result, the identification portion 500 according to an embodiment may perform the same function as that of the related art marking part, while preventing degradation of characteristics of components.

Referring to FIGS. 4 to 7, the identification portion 500 may include first and second fine patterns P1 and P2 having a circular or polygonal cross-sectional shape. In addition, the identification portion 500 may include at least two fine patterns P1 and P2 having different cross-sectional shapes. As an example, referring to FIG. 4, the identification portion 500 may include a first fine pattern P1 having a hexagonal cross sectional shape, and a second fine pattern P2 disposed outside of the first fine pattern P1 and having a shape allowing for the identification portion 500 to have a quadrangular shape as a whole of the identification portion 500.

Figure 5:
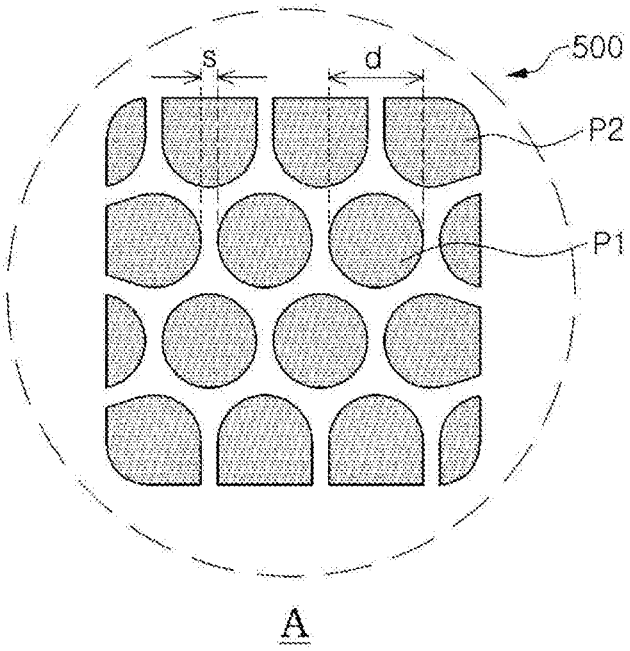

As another example, as illustrated in FIG. 5, the identification portion 500 may include a first fine pattern P1 having a circular cross-sectional shape, and a second fine pattern P2 disposed outside of the first fine pattern P1 and having a shape allowing for the identification portion 500 to have a quadrangular shape as a whole of the identification portion 500.

Figure 6:
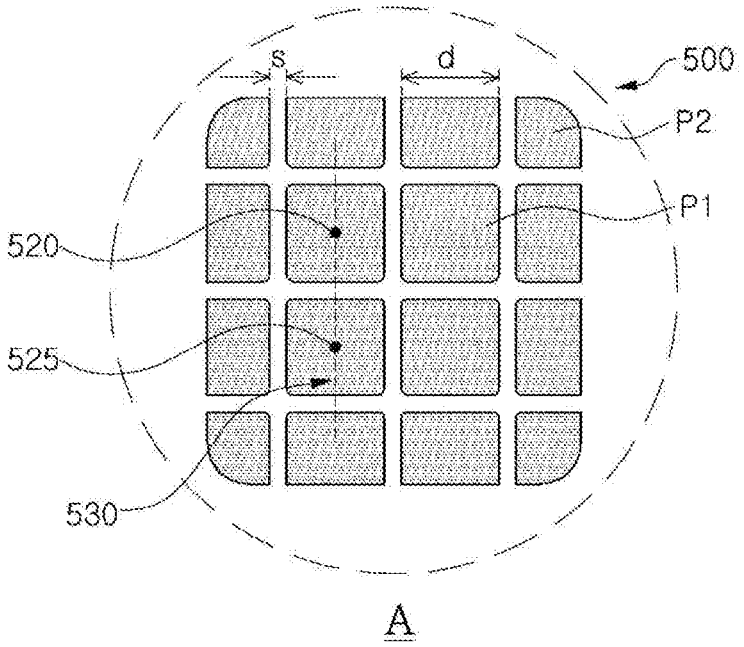

As yet another example, as illustrated in FIG. 6, the identification portion 500 includes a first fine pattern P1 having a quadrangular cross-sectional shape having a rounded corner, and a second fine pattern P2 disposed outside of the first fine pattern P1 and having a shape allowing for the identification portion 500 to have a quadrangular shape as a whole of the identification portion 500.

Figure 7:
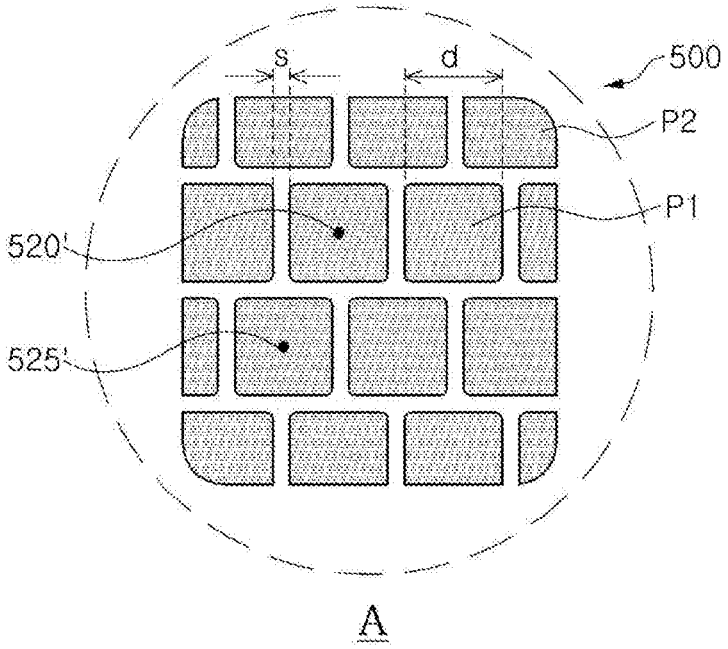

As a further example, as illustrated in FIG. 7, the identification portion 500 also include a first fine pattern P1 having a quadrangular cross-sectional shape having a rounded corner, and a second fine pattern P2 disposed outside of the first fine pattern P1 and having a shape allowing for the identification portion 500 to have a quadrangular shape as a whole of the identification portion 500.

As illustrated in FIGS. 6 and 7, the first fine pattern P1 may be disposed to form a plurality of rows. In this case, as illustrated in FIG. 6, a center 520 of a first fine pattern P1 which is one of plurality of entries of [ohk1] a first row, and a center 525 of another first fine pattern P1 which is one of plurality of entries of a second row, may be located together on a virtual line segment 530 perpendicular to the first and second rows. In addition, as illustrated in FIG. 7, a center 520' of a first fine pattern P1 which is one of plurality of entries of the first row, and a center 525' of another first fine pattern P1 which is one of plurality of entries of the second row, may not be located together on a virtual line segment perpendicular to the first and second rows. On the other hand, although FIGS. 1 and 4 to 7 illustrate that the outline of the identification portion 500 is formed to have a quadrangle as a whole, which is merely an example, for example, the identification portion 500 may be modified to have various shapes such as a polygon, a circle, an elliptical shape, or the like, in addition to a quadrangular shape as an overall outer appearance. In addition, as illustrated in FIGS. 4 to 7, the second fine pattern P2 may include two or more fine patterns of which cross-sectional shapes are different from each other.

A width d of the plurality of fine patterns P1 and P2 may be about 50 μm or more. If the width d of the plurality of fine patterns P1 and P2 is less than about 50 μm, a portion of the plurality of fine patterns P1 and P2 may not be printed reproducibly and it may be difficult to identify the identification portion 500 with an identification device. On the other hand, since the shape of cross sections of the plurality of fine patterns P1 and P2 is not limited, the width d of the plurality of fine patterns P1 and P2 refers to a diameter when the shape of the cross section is circular, and refers to a distance between two sides facing each other, when the shape of the cross section is a polygon having two sides facing each other in parallel.

A thickness of the plurality of fine patterns P1 and P2 may be about 4.5 μm or more. If the thickness of the plurality of fine patterns P1 and P2 is less than about 4.5 μm, a portion of the plurality of fine patterns P1 and P2 may not be reproducibly printed and it may be difficult to identify the identification portion 500 by the identification device.

A spacing distance s between the plurality of fine patterns P1 and P2 may be from about 10 μm to about 30 μm or less. If the spacing distance s between the plurality of fine patterns P1 and P2 is less than about 10 μm, adjacent fine patterns P1 and P2 may be connected to each other to increase the thickness of the identification portion 500. If the spacing distance s between the plurality of fine patterns P1 and P2 is more than about 30 μm, an error may occur when the identification portion 500 is identified by the identification device.

The insulating film IF may be formed along the surfaces of the first coil pattern 211, the internal insulating layer IL, and the second coil pattern 212. The insulating film IF protects and insulates the respective coil patterns 211 and 212, and includes a known insulating material such as parylene. Any insulating material included in the insulating film IF may be used without particular limitations. The insulating film IF may be formed by vapor deposition or the like, but an embodiment thereof is not limited thereto. For example, the insulating film IF may be formed by forming an insulating material such as an insulating film on both surfaces of the internal insulating layer IL on which the first and second coil patterns 211 and 212 are formed. The above-described insulating film IF may be omitted in this embodiment depending on design requirements or the like.

Although not illustrated in the drawings, at least one of the first coil pattern 211 and the second coil pattern 212 may be formed of a plurality of layers. As an example, the coil portion 200 may have a structure in which a plurality of first coil patterns 211 are formed, in detail, one of the first coil patterns is laminated on another first coil pattern. In this case, an additional insulating layer may be disposed between the plurality of first coil patterns 211, and a connecting via may be formed in the additional insulating layer to penetrate therethrough, to connect the adjacent first coil patterns to each other.

Further Embodiment

Figure 8:
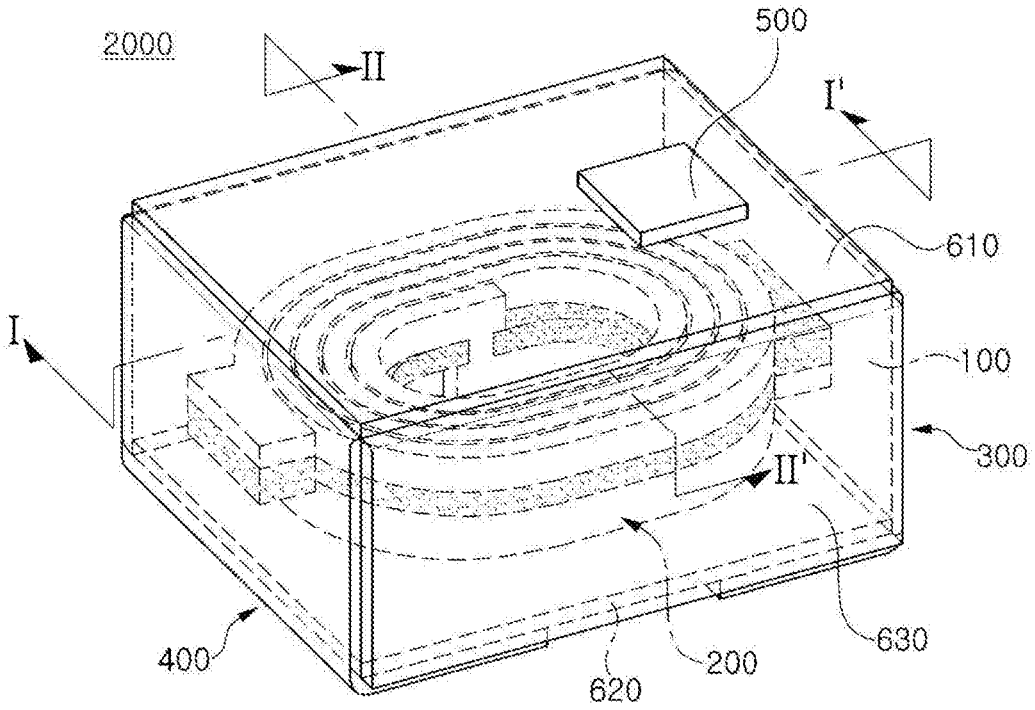
FIG. 8 is a perspective view schematically illustrating a coil component according to another embodiment.

FIG. 8 is a perspective view schematically illustrating a coil component according to another embodiment in the present disclosure.

Referring to FIGS. 1 to 8, a coil component 2000 according to another embodiment further includes insulating layers 610, 620 and 630 as compared with those of the coil component 1000 according to the foregoing embodiment. Therefore, only the insulating layers 610, 620 and 630 will be described in the description according to the embodiment. For the remaining configurations according to the embodiment, the above description of the foregoing embodiment may be applied as it is thereto.

Referring to FIG. 8, the insulating layers 610, 620 and 630 surround a body 100, and openings corresponding to first and second external electrodes 300 and 400 are formed. In the case of this embodiment, an identification portion 500 is disposed on the insulating layers 610, 620 and 630.

The insulating layers 610, 620 and 630 may be, for example, a first insulating layer 610, a second insulating layer 620 and a third insulating layer 630, respectively. In detail, the first insulating layer 610 is disposed on the fifth surface 105 of the body 100 to cover the fifth surface 105 of the body 100. The second insulating layer 620 is disposed on the sixth surface 106 of the body 100. The third insulating layer 630 may be disposed on the first to fourth surfaces 101, 102, 103 and 104 of the body 100.

The coil component 2000 according to the embodiment may be manufactured by manufacturing a coil substrate in which a plurality of bodies are connected to each other, and by dicing the coil substrate to separate a plurality of bodies, and then by forming external electrodes 300 and 400 on an outer surface of each body. In this case, the first and second insulating layers 610 and 620 may be disposed on both surfaces of the coil substrate before dicing the coil substrate. Asa result, in the case of each body after the dicing process, the sides of the first and second insulating layers 610 and 620 and the first to fourth surfaces 101, 102, 103 and 104 of the body 100 may be disposed on substantially the same plane.

The third insulating layer 630 may be formed on exposed first to fourth surfaces of each body after the dicing process described above. In this case, openings having the form corresponding to the first and second connection portions 310 and 410 of the external electrodes 300 and 400, while exposing both ends of the coil portion 200, may be formed in the third insulating layer 630 disposed on the first and second surfaces 101 and 102 of the body 100.

The first to third insulating layers 610, 620 and 630 may be respectively formed by laminating an insulating film on the outer surface of the body 100 or by applying an insulating paste to the outer surface of the body 100.

The first to third insulating layers 610, 620 and 630 may include a thermoplastic resin such as a polystyrene type, a vinyl acetate type, a polyester type, a polyethylene type, a polypropylene type, a polyamide type, a rubber, acrylic resin or the like, a thermosetting resin such as phenol-based, epoxy-based, urethane-based, melamine-based, alkyd-base resin or the like, a photoimageable resin, or a parylene.

The first to third insulating layers 610, 620 and 630 may further include a filler dispersed in the above-described insulating resin. The filler may be an inorganic filler or an organic filler, a powder phase of an insulating resin. As the inorganic filler, one or more selected from the group consisting of silica ($SiO_2$), alumina ($Al_2O_3$), silicon carbide (SiC), barium sulphate ($BaSO_4$), talc, mud, mica powder, aluminum hydroxide ($AlOH_3$), magnesium hydroxide ($Mg(OH)_2$), calcium carbonate ($CaCO_3$), magnesium carbonate ($MgCO_3$), magnesium oxide (MgO), boron nitride (BN), aluminum borate ($AlBO_3$), barium titanate ($BaTiO_3$) and calcium zirconate ($CaZrO_3$).

On the other hand, in forming the external electrodes 300 and 400 on the surface of the body 100 by the plating process, the first to third insulating layers 610, 620 and 630 may be used as a plating resist.

As set forth above, according to an embodiment, an identification portion may be formed to have a relatively thin thickness, while being easily identified.

According to an embodiment, the volume of a nonmagnetic body may be reduced, in the same volume of a coil component as that in the related art.

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed to have a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A coil component comprising:

a body;

a coil portion embedded in the body;

first and second external electrodes spaced apart from each other, the first and second external electrodes being disposed on a first external surface of the body and connected to the coil portion;

an identification portion in which a plurality of patterns spaced apart from one another are grouped and which is disposed on a second external surface of the body opposite the first external surface; and an external insulating layer surrounding the body, the identification portion being disposed on the external insulating layer, wherein each of the plurality of patterns includes an insulating resin.

2. The coil component of claim 1, wherein the plurality of patterns have a width of 50 μm or more.

3. The coil component of claim 1, wherein the plurality of patterns have a thickness of 4.5 μm or more.

4. The coil component of claim 1, wherein a distance between adjacent of the plurality of patterns is from 10 μm to 30 μm.

5. The coil component of claim 1, wherein the plurality of patterns comprises a first pattern, and a second pattern having a cross-sectional shape different from a cross-sectional shape of the first pattern.

6. The coil component of claim 5, wherein a cross section of the first pattern is one of a circle, a quadrangle, or a hexagon.

7. The coil component of claim 5, wherein the first pattern is disposed to form a plurality of rows, wherein an entry of any one of the plurality of rows and an entry of another row of the plurality of rows are located together on a virtual single line segment between the entries.

8. The coil component of claim 5, wherein the first pattern is disposed to form a plurality of rows, wherein an entry of any one of the plurality of rows and an entry of another row of the plurality of rows are not located together on a virtual single line segment between the entries.

9. The coil component of claim 1, wherein the plurality of patterns comprise at least one of a circular cross-sectional shape, a quadrangular cross-sectional shape, or a hexagonal cross-sectional shape.

10. The coil component of claim 1, further comprising:

an internal insulating layer embedded in the body, wherein the coil portion is disposed on at least one surface of the internal insulating layer.

11. The coil component of claim 1, wherein the external insulating layer has openings corresponding to the first and second external electrodes.

12. A coil component comprising:

a coil portion enclosed in a body, the coil portion having a first connecting portion and a second connecting portion;

a first external electrode and second external electrode each having at least a portion disposed on a first external surface of the body connected respectively to the first and second connecting portions, the portions of the first and second external electrodes disposed on the first external surface being spaced apart from each other; and an external insulating layer surrounding the body;

an identification portion comprising an insulating resin disposed on a portion of a second external surface of the body different from the first external surface, the identification portion protruding outwardly from an outer surface of the external insulating layer.

13. The coil component of claim 12, wherein the identification portion includes a plurality of patterns having a thickness of 4.5 μm or more.

14. The coil component of claim 12, wherein the identification portion includes a plurality of patterns have a polygonal or circular cross-sectional shape.

15. The coil component of claim 12, wherein the coil portion comprises an insulating layer, a first coil pattern disposed on a first side of the insulating layer and connected to the first connecting portion, a second coil pattern disposed on a second side of the insulating layer opposite the first side and connected to the second connecting portion, and a via penetrating the insulating layer and connecting the first coil pattern to the second coil pattern.

16. The coil component of claim 12, wherein the first external surface is a mounting surface for the coil component.

* * * * *